US006471082B1

(12) United States Patent
Fritzinger

(10) Patent No.: US 6,471,082 B1
(45) **Date of Patent: *Oct. 29, 2002**

(54) FUSIBLE PRESSURE RELIEVING DRUM CLOSURE

(75) Inventor: Daniel Duane Fritzinger, Grabill, IN (US)

(73) Assignee: Rieke Corporation, Auburn, IN (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/992,281

(22) Filed: Dec. 17, 1997

(51) Int. Cl.[7] ..... B65D 51/16

(52) U.S. Cl. ..... 220/203.08; 220/89.2; 220/265; 220/203.01; 220/360; 220/367.1; 137/68.12

(58) Field of Search ..... 220/203.01, 203.08, 220/203.13, 203.19, 265, 288, 367.1, 601, 89.2, 89.1, 360, 73; 137/68.27, 68.23, 68.19, 68.12

(56) References Cited

U.S. PATENT DOCUMENTS

| | | | | | |
|---|---|---|---|---|---|
| 2,326,771 | A | * | 8/1943 | Eidson | 220/89.2 X |
| 2,445,465 | A | * | 7/1948 | Amesbury et al. | 220/284 |
| 2,546,672 | A | * | 3/1951 | LeClair | 220/DIG. 19 X |
| 2,608,201 | A | * | 8/1952 | Henry | 137/68.12 X |
| 2,726,002 | A | * | 12/1955 | Dalianis | 220/89.2 X |
| 2,772,017 | A | * | 11/1956 | Rieke | 220/265 |
| 2,774,507 | A | * | 12/1956 | Hurley | 220/284 |
| 3,116,747 | A | * | 1/1964 | Cowles et al. | 137/68.23 |
| 3,454,177 | A | * | 7/1969 | Bloom | 215/355 X |
| 3,559,834 | A | * | 2/1971 | Taylor | 215/261 |
| 3,905,091 | A | | 9/1975 | LaRocque | |
| 4,146,047 | A | | 3/1979 | Wood et al. | |
| 4,219,126 | A | | 8/1980 | Oana | |
| 4,273,251 | A | | 6/1981 | McMahon | |
| 4,347,942 | A | * | 9/1982 | Jernberg et al. | 137/38.27 X |
| 4,413,746 | A | | 11/1983 | Matsutani | |
| 4,513,874 | A | * | 4/1985 | Mulawski | 220/89.2 |
| 4,549,565 | A | | 10/1985 | Short, III | |
| 4,576,303 | A | * | 3/1986 | Mundt et al. | 137/68.27 X |
| 4,588,101 | A | * | 5/1986 | Ruegg | 137/68.27 X |
| 4,610,370 | A | | 9/1986 | Patterson et al. | |
| 4,706,798 | A | | 11/1987 | Short, III | |
| 4,706,836 | A | | 11/1987 | Greck | |
| 4,738,372 | A | * | 4/1988 | Jernberg | 137/38.27 X |
| 4,750,510 | A | | 6/1988 | Short, III | |
| 4,785,963 | A | * | 11/1988 | Magley | 220/294 |
| 4,896,690 | A | * | 1/1990 | Taylor | 137/73 |
| 4,899,777 | A | | 2/1990 | Stone et al. | |
| 5,022,424 | A | * | 6/1991 | Reynolds et al. | 137/68.27 |
| 5,042,675 | A | | 8/1991 | Patterson | |

(List continued on next page.)

FOREIGN PATENT DOCUMENTS

| | | | | |
|---|---|---|---|---|
| CA | 457847 | * | 7/1949 | 220/367.1 |
| FR | 1246812 | * | 10/1960 | 215/355 |

*Primary Examiner*—Lee Young
*Assistant Examiner*—Robin A. Hylton
(74) *Attorney, Agent, or Firm*—Robert H. Earp, III; McDonald, Hopkins, Burke & Habor LPA

(57) ABSTRACT

A closure for threadable insertion within an opening of a drum and capable of venting the drum when exposed to elevated pressures and temperatures to prevent the build-up of explosive pressures within the drum. A center portion of the closure is molded with thinner dimensions allowing the center to distort as a result of heat and internal pressures. At elevated levels, the center portion ruptures venting internal container pressure. In order to ensure venting at proper levels while maintaining integrity for the transport of materials, the center portion includes a downwardly depending circular flange and a series of lugs on the upper surface.

10 Claims, 2 Drawing Sheets

U.S. PATENT DOCUMENTS 5,180,073 A * 1/1993 Fay et al. ..... 215/261
5,197,622 A 3/1993 Anderson
5,213,128 A * 5/1993 Baird ..... 137/73
5,382,408 A * 1/1995 Perlman ..... 215/295
5,544,779 A 8/1996 Yamamoto et al.
5,551,470 A * 9/1996 Duvall ..... 137/68.12
5,632,505 A 5/1997 Saccone et al.
5,647,390 A * 7/1997 Wass ..... 137/68.12
5,673,934 A 10/1997 Saccone et al.
5,680,953 A * 10/1997 Baughman ..... 220/288
5,766,790 A * 6/1998 Kameishi et al. ... 220/203.01 X

* cited by examiner

FUSIBLE PRESSURE RELIEVING DRUM CLOSURE

BACKGROUND OF THE INVENTION

I. Field of the Invention

This invention relates to threaded closures for drum containers to prevent the escape of materials from within the drum and, in particular, to a closure having a structural and material composition capable of rupturing when exposed to elevated temperatures and pressures to vent the drum container.

II. Description of the Prior Art

Closures are utilized in drum containers to selectively enclose materials within the container. Such closures can include spout closures which facilitate pouring of materials from the container and threaded closures which must be removed from the container opening to access material. However, this same sealing property can result in a pressure build-up when the containers are exposed to elevated temperatures such as in a fire. Accordingly, it is desirable for a closure to seal the container for transport of materials but vent a build-up of pressure within the container to prevent explosive rupturing of the drum container.

The prior known rupturable closures typically include a second wall or membrane which breaks under predetermined pressures. The scores or grooves control the rupture configuration which also determines the pressures needed to rupture the closure. These same scores can cause the closure to inadvertently rupture resulting in leakage of material from the container. What is needed is an integral closure which ruptures after deforming due to extreme temperatures.

SUMMARY OF THE PRESENT INVENTION

The present invention overcomes the disadvantages of the prior known closures by providing a threaded closure for a drum container which incorporates a center portion deformable under extreme temperatures and pressure to rupture and vent pressure build-up from the container.

The venting drum closure of the present invention is adapted to be threadably seated within an opening of a drum container to present escape of materials within the container. The closure includes an annular sidewall having threads on the exterior surface. Extending outwardly at substantially a right angle to the sidewall is an annular flange to facilitate handling of the closure and provide for a sealing surface against the container. A base wall extends across the closure within the annular sidewall. The base wall includes an annular outer portion of a first material thickness and an inner or central portion of a second, thinner material thickness. The material composition and thickness of the central portion causes the center to distort under predetermined temperatures and pressures eventually rupturing to vent internal pressures within the drum container. Conversely, the center portion is sufficiently stable to prevent inadvertent rupture and leakage past the closure. The base wall includes additional structure to maintain the integrity of the closure during normal operation. An annular flange depends downwardly from the underside of the base wall substantially encircling the thinner central portion. Formed on the topside of the base wall are a plurality of lugs peripherally spaced along the side wall. In a preferred embodiment, the lugs have a substantially trapezoidal configuration so as not to extend over the central portion of the base wall. Nevertheless, the lugs provide added support to the base wall to maintain integrity during normal use. Accordingly, the closure of the present invention has sufficient structural integrity to meet requirements for transportation of materials yet will vent potentially explosive pressures from the drum container when subjected to elevated temperatures and pressures.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
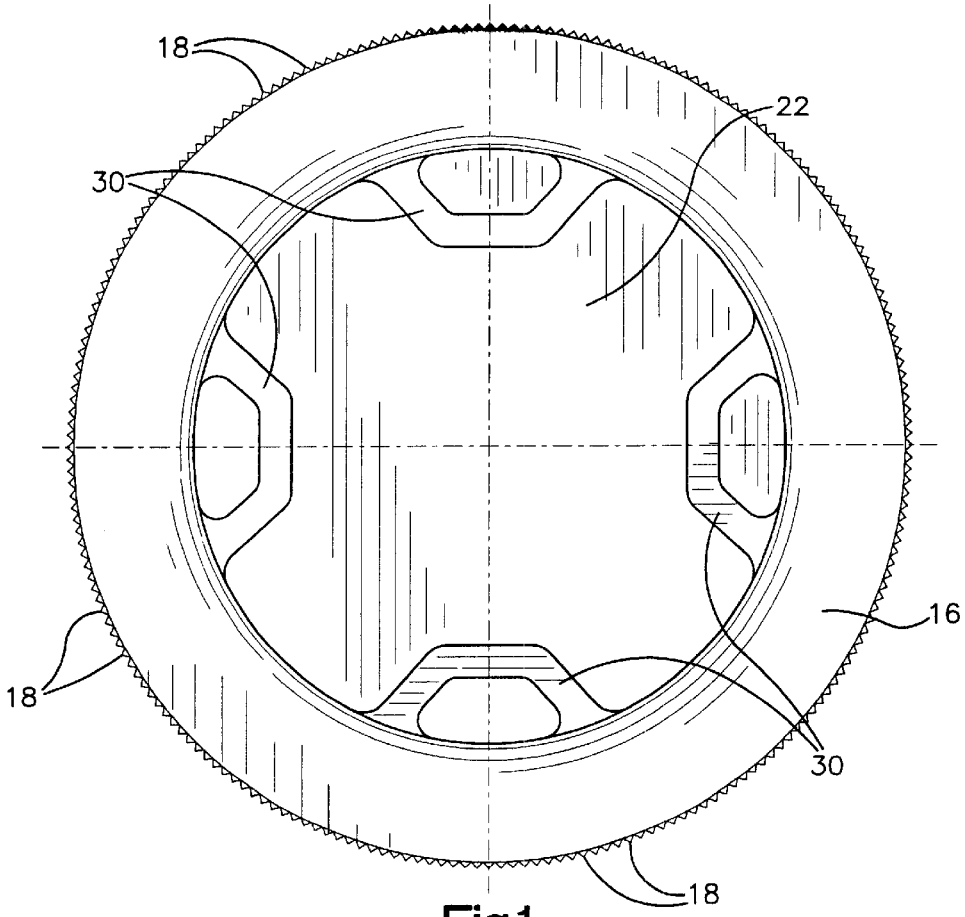
FIG. 1 is a top plan view of a closure embodying the present invention.
Figure 2:
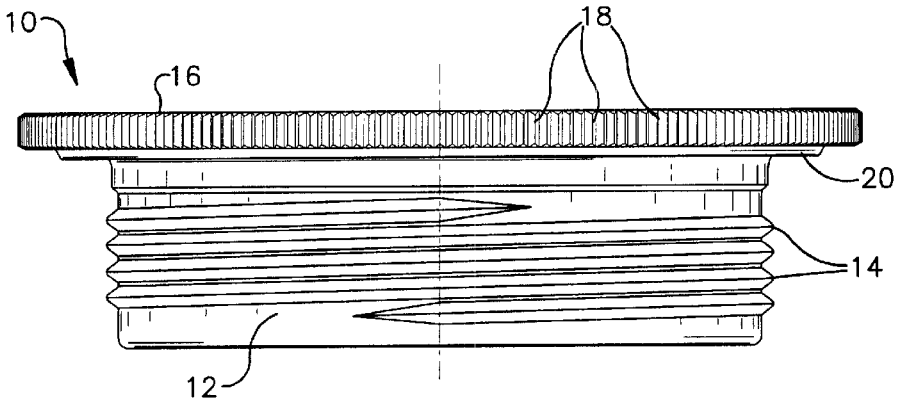
FIG. 2 is a side view thereof.

Referring to the drawing figures, there is shown a threaded closure 10 adapted to close and seal a container (not shown) such as a drum to provide selective access to materials within the container. The typical drum container includes a threaded opening from which materials may be dispensed. The closure 10 embodying the present invention is threadably received within the container opening to seal the container and maintain material within the container during transport and storage. However, as will be subsequently described, the structural properties and material composition of the closure 10 allow it to rupture at predetermined temperatures and internal pressures to vent any build-up of pressure from within the container.

The closure 10 includes an annular side wall 12 sized to matingly fit within the opening of the container and including external threads 14 adapted to cooperate with corresponding threads of the container opening. Integrally molded at an upper end of the sidewall 12 is an annular flange 16 disposed substantially at a right angle to the sidewall 12 and extending radially outwardly. The flange 16 facilitates manipulation of the closure 10 and may include ribs 18 for rotating the closure 10 within its opening. In a preferred embodiment the underside of the flange 16 has a seal bead 20 for engaging the top of the container via a gasket upon insertion of the closure 10.

Figure 3:
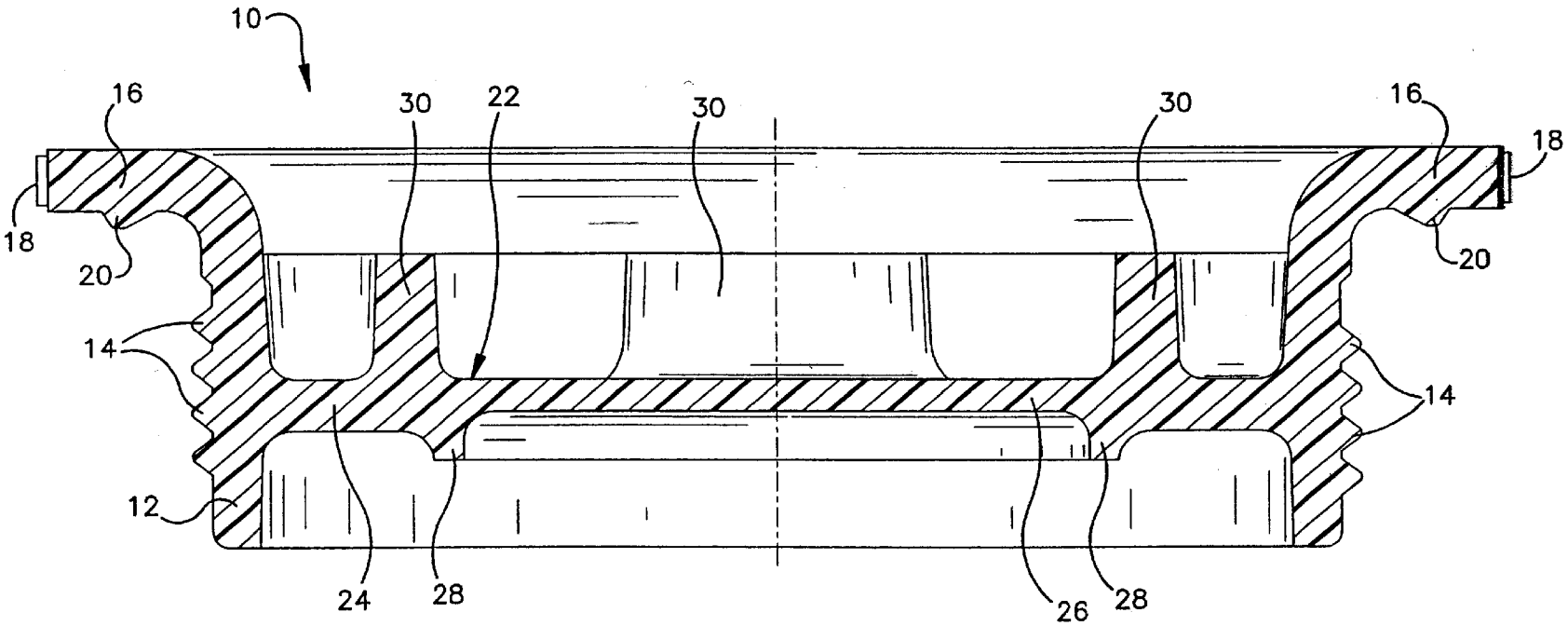
FIG. 3 is a cross-sectional view of the closure.

As best shown in FIG. 3, a base wall 22 extends across the closure within the sidewall 12 to form an integral closure 10 capable of sealing the container opening. The base wall 22 consists of two portions: an annular outer portion 24 having a first material thickness and an inner or center portion 26 having a second, thinner material thickness. The thickness of the center portion 26 is chosen to deform and rupture at predetermined temperatures and pressure levels in order to vent the container.

The base wall 22 includes additional structure to maintain the integrity of the closure 10 during normal storage and transport of the container. An annular flange 28 depends downwardly from the underside of the base wall 22 substantially encircling the thinner center portion 26. Extending upwardly from the base wall 22 are a plurality of lugs 30 peripherally spaced along the side wall 12. Preferably, in conjunction with the side wall 12, the lugs 30 have a substantially trapezoidal configuration so as not to extend over the center portion 26 of the base wall 22. However, the lugs 30 provide added integrity to the outer portion 24.

The material composition and structural features of the closure 10 allow it to meet requirements for sealing of containers for the transport and storage of materials while also venting potentially explosive pressures from the container at elevated temperatures and internal pressures. The closure 10 is integrally molded using a nylon material such as DSM's "AKULON K123" or Dupont's "ZYTEL 7335F". At elevated temperatures and pressures the center portion 26 will deform and distort until the center 26 ruptures to vent internal pressures from the container preventing a potentially explosive build-up of pressure within the container.

The foregoing detailed description has been given for clearness of understanding only and no unnecessary limitations should be understood therefrom as some modifications will be obvious to those skilled in the art without departing from the scope and spirit of the appended claims.

What is claimed is:

1. A closure adapted to be removably seated within an opening of a container for selective access to materials within the container, said closure comprising:

an annular sidewall adapted to be removably received within a container opening, the annular sidewall having an annular flange integrally molded with said sidewall, said flange extending radially outwardly, substantially perpendicular to said sidewall; and a base wall integrally molded said sidewall to extend across said closure, said base wall having a top side and an underside, and further having a downwardly depending annular flange integrally formed on said underside of said base wall, and including a substantially annular, outer, planar portion having a first material thickness and a center, planar portion disposed within said annular, outer, planar portion, said center portion having a second material thickness less than the thickness of said outer portion, and wherein said center portion is deformable upon exposure to elevated temperatures and pressures to allow escape of fluid through said base wall of said closure.

2. The closure as described in claim 1 wherein said downwardly depending annular flange is formed on the underside of the base wall at the juncture of said outer portion and said center planar portion, said downwardly depending annular flange extending circumferentially around said center planar portion.

3. The closure as described in claim 1, and further comprising a plurality of lugs integrally molded with, and extending upwards from, the annular outer portion of said base wall, said lugs radially spaced along said outer portion of said base wall.

4. The closure as described in claim 3 wherein said lugs have a substantially trapezoidal configuration.

5. A closure adapted to be seated within an opening of a container for selective access to materials within the container, said closure comprising:

an annular sidewall with threads formed on an outer surface of said sidewall for threaded engagement with a container opening;

an annular flange integrally molded with said sidewall, said flange extending radially outwardly substantially perpendicular to said sidewall; and a base wall integrally molded within said sidewall, said base wall having a downwardly depending annular flange integrally formed on an underside of said base wall, said base wall further having an annular outer planar portion having a first material thickness and a substantially planar center portion having a second substantially uniform material thickness less than said material thickness of said outer portion extending circumferentially around said center portion, said center portion deformable upon exposure to elevated temperatures and pressures to vent fluid from the container through said base wall of said closure.

6. The closure as defined in claim 5 wherein said downwardly depending annular flange is formed on said base wall at the juncture of said outer planar portion and said center planar portion to extend circumferentially around said center portion.

7. The closure as defined in claim 5 and further comprising a plurality of lugs integrally molded with, and extending upwards from, the annular outer planar portion of said base wall, said lugs radially spaced along said outer portion of said base wall.

8. The closure as defined in claim 7 wherein said lugs have a substantially trapezoidal configuration.

9. A closure adapted to be seated within an opening of a container for selective access to materials within the container, said closure comprising:

an annular sidewall with threads formed on an outer surface of said sidewall for threaded engagement with a container opening:

an annular flange integrally molded with said sidewall, said flange extending radially outwardly substantially perpendicular to said sidewall;

a base wall integrally molded within said sidewall, said base wall having an upper surface and an underside, and including an annular outer portion having a first material thickness and a center portion having a second material thickness less than said material thickness of said outer portion, said center portion deformable upon exposure to elevated temperatures and pressures to vent fluid from the container through said closure;

said base wall having a downwardly depending annular flange integrally formed on the underside of said base wall at the juncture of said outer portion and center portion, said downwardly depending annular flange extending circumferentially around said center portion; and a plurality of lugs integrally molded to and extending upwards from the annular outer portion of said base wall, said lugs being radially spaced along said outer portion of said base wall.

10. The closure as described in claim 9 wherein said lugs have a substantially trapezoidal configuration.

* * * * *